US006032663A

United States Patent [19]

Pencheon

[11] Patent Number: 6,032,663

[45] Date of Patent: Mar. 7, 2000

[54] STOVE EMERGENCY CUTOFF SYSTEM

[76] Inventor: Vance R Pencheon, Christ Church, St. Kitts/Nevis

[21] Appl. No.: 08/842,734

[22] Filed: Apr. 16, 1997

[51] Int. Cl.[7] ..... F24C 3/12

[52] U.S. Cl. ..... 126/42; 340/577; 340/590

[58] Field of Search ..... 126/42, 35, 25 C, 126/24, 1 R; 340/577, 578, 590

[56] References Cited

U.S. PATENT DOCUMENTS

| | | | |
|---|---|---|---|
| 510,115 | 12/1893 | Cantrell | 340/590 |
| 1,308,684 | 7/1919 | Ruchty | 340/577 |
| 1,799,583 | 4/1931 | Dougherty | 340/590 |
| 1,802,805 | 4/1931 | Castronovo | 340/590 |
| 2,641,314 | 6/1953 | Douvan . | |
| 2,920,167 | 1/1960 | Hill | 340/590 |
| 3,653,443 | 4/1972 | Dockery | 340/577 |
| 3,772,499 | 11/1973 | Fritzsche | 340/577 |
| 3,866,687 | 2/1975 | Banner | 340/577 |
| 4,070,670 | 1/1978 | Chen . | |
| 4,262,687 | 4/1981 | Kobayashi et al. | 340/577 |
| 4,263,928 | 4/1981 | Kobayashi et al. | 340/577 |
| 4,356,870 | 11/1982 | Gaylord et al. | 340/577 |
| 4,491,142 | 1/1985 | Shimizu . | |
| 4,675,541 | 6/1987 | Peters et al. | 340/577 |
| 5,235,323 | 8/1993 | Chien | 340/590 |
| 5,400,766 | 3/1995 | Dillon . | |

FOREIGN PATENT DOCUMENTS

| | | | |
|---|---|---|---|
| 856259 | of 1940 | France | 340/590 |
| 401487 | of 1943 | Italy | 340/590 |
| 13833 | of 1900 | Sweden | 340/590 |
| 274445 | of 1951 | Sweden | 340/590 |
| 555268 | of 1941 | United Kingdom | 340/590 |
| 1461770 | of 1977 | United Kingdom | 340/590 |

*Primary Examiner*—James C. Yeung
*Assistant Examiner*—David Lee
*Attorney, Agent, or Firm*—Michael I. Kroll

[57] ABSTRACT

A stove emergency cutoff system (16) comprising a stove (18) having a front wall (20), a rear wall (22), a top wall (24), laterally spaced side walls (26), a plurality of burners (28) in the top wall (24) and a plurality of control knobs (30) for the burners (28) in the front wall (20). A facility (32) is for deactivating any control knob (30) that is turned on when food (34) in a cooking utensil (36) on one of the burners (28) is on fire and is producing a large flame (38), so as to shut down the stove (18), and as a result will cause the fire to go out.

8 Claims, 11 Drawing Sheets

STOVE EMERGENCY CUTOFF SYSTEM

BACKGROUND OF THE INVENTION

1. Field of the Invention

The instant invention relates generally to automatic shut-off devices and more specifically it relates to a stove emergency cutoff system. The stove emergency cutoff system will turn off electric or gas stoves if something cooking on the stove starts to burn and produce a large flame, which will activate the system.

2. Description of the Prior Art

Numerous automatic shut-off devices have been provided in prior art. For example, U.S. Pat. Nos. ,641,314 to Douvan; 4,070,670 to Chen; 4,491,142 to Shimizu and 5,400,766 to Dillon all are illustrative of such prior art. while these units may be suitable for the particular purpose to which they address, they would not be as suitable for the purposes of the present invention as heretofore described.

U.S. Pat. No. 2,641,314 discloses an automatic cutoff valve for fluid fuel burners, the combination with a valve casing in the conduit through which the fluid fuel is fed to the burner and a manually adjustable rotary valve in the valve casing, of a first rotary element in the form of a disc rigidly secured to the valve and provided with ratchet teeth on at least part of its periphery. A first spring urges the valve to its closed position. A detent is arranged to cooperate with the ratchet teeth on the disc to hold the valve in an open position. A second rotary element in the form of a cam is supported co-axially with and is rotatable relatively to the disc and valve. A second spring weaker than the first spring and urging the cam toward an angular position corresponds to that of the disc and valve. The cam has a raised portion for cooperation with the detent when the cam assumes an operative position corresponding to a predetermined opening of the valve, so as to release the disc and valve from the detent for return to the closed position of the valve. A delay mechanism is operatively associated with the cam, to delay movement of the latter from its position corresponding to the closed position of the valve to its operative position for a predetermined initial period after the valve has been opened. A thermostat is adapted to be installed adjacent the burner. A means is controlled by the thermostat and is operative if the thermostat has become heated by the burner flame prior to the end of the initial period and as long as the thermostat is heated to interfere with the movement of one of the rotary elements, so as to prevent release of the valve for return to the closed position.

U.S. Pat. No. 4,070,670 discloses a safety control shut-off device for the heating element of a cooking stove. In one embodiment of this safety device, a burner plate of the stove is provided with several declining U-shaped grooves for collecting any spillage or overflow of water from the cooking operations. Water drops collected in the declining grooves are led through a discharge outlet, at the lowest portion of the grooves, and into a water drop detector located beneath the outlet, to complete an electrical circuit, which in turn will actuate and sound an alarm and will also actuate means for disconnecting the fuel source of the plate burner.

U.S. Pat. No. 4,491,142 discloses an automatic fuel supply stopping device incorporated in fuel combustion equipment includes a shut-off valve and a combustor. The automatic fuel supply stopping device comprises a fluid intercepting mechanism interposed in a channel through which the fuel supply to the combustor is supplied. A photosensor is adapted to detect fuel combustion in the combustor by radiation emitted from a thermosensitive luminous medium. The fluid intercepting mechanism alternately takes its first stable state or passage blocking state and is changed over, in response to an output from a sensor circuit, from the passage opening state to the passage blocking state.

U.S. Pat. No. 5,400,766 discloses a gas appliance stove safety valve system that incorporates a safety valve assembly between the gas line manifold of the stove and the wall shut-off valve from the main gas line. The safety valve assembly is mounted adjacent the rear of the gas appliance stove beneath an aperture in its top wall. A special structure is utilized to fasten the ball valve assembly to the top wall of the stove. A special key is utilized that can be inserted through the aperture in the top wall of the stove to rotate the valve stem of the ball valve assembly between a closed position and an open position. There is also a structure for preventing removal of the key unless the safety valve assembly is actuated to its shut-off position.

SUMMARY OF THE INVENTION

A primary object of the present invention is to provide a stove emergency cutoff system that will overcome the shortcomings of the prior art devices.

Another object is to provide a stove emergency cutoff system that will disengage an electric circuit in an electric stove, when something cooking thereon starts to burn rapidly and produces a large flame setting off the system.

An additional object is to provide a stove emergency cutoff system that will shut down a gas line in a gas stove, when something cooking thereon starts to burn rapidly and produces a large flame setting off the system.

A further object is to provide a stove emergency cutoff system that is simple and easy to use.

A still further object is to provide a stove emergency cutoff system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
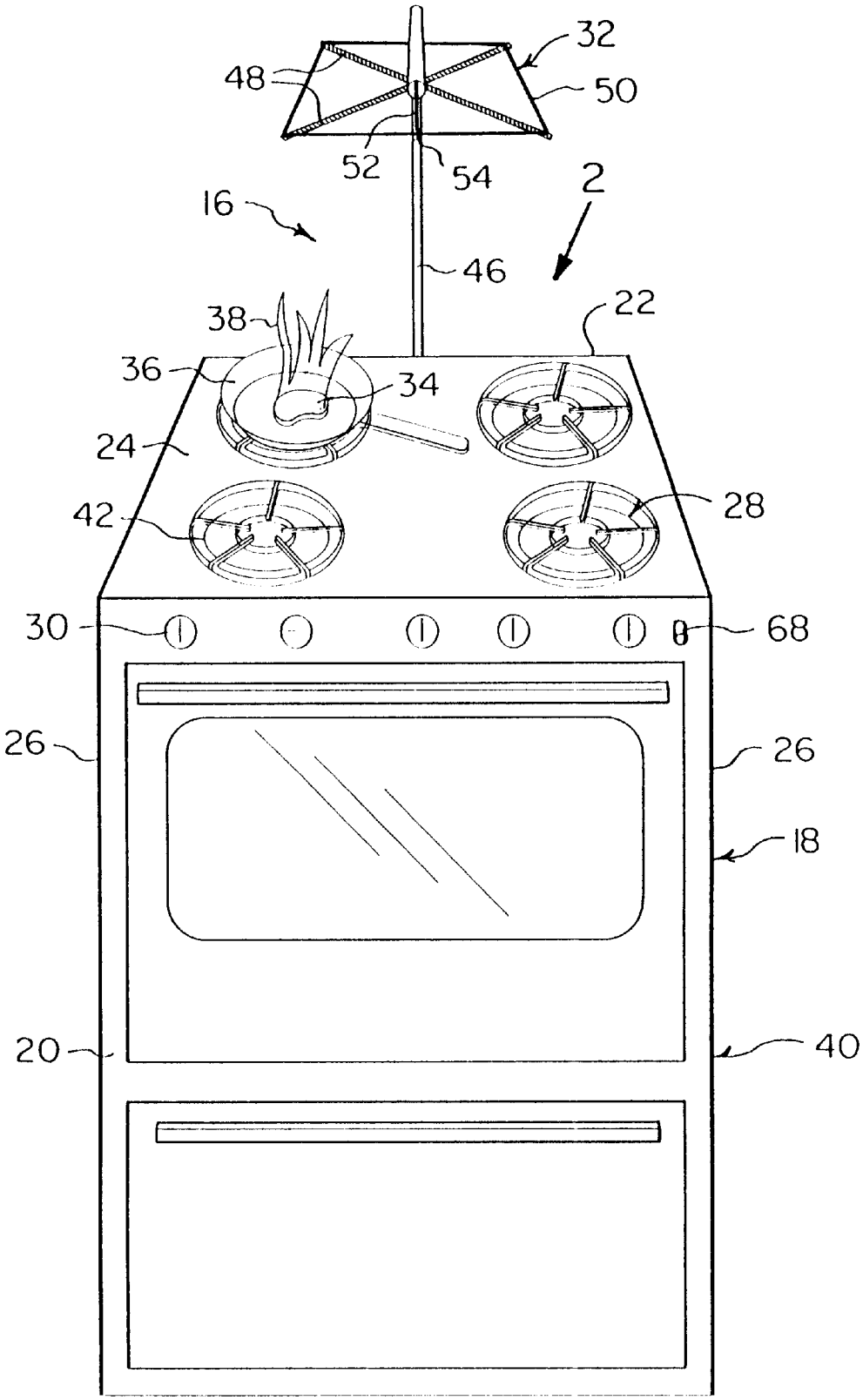
FIG. 1 is a front perspective view of a first embodiment of the instant invention for an electric stove.
Figure 2:
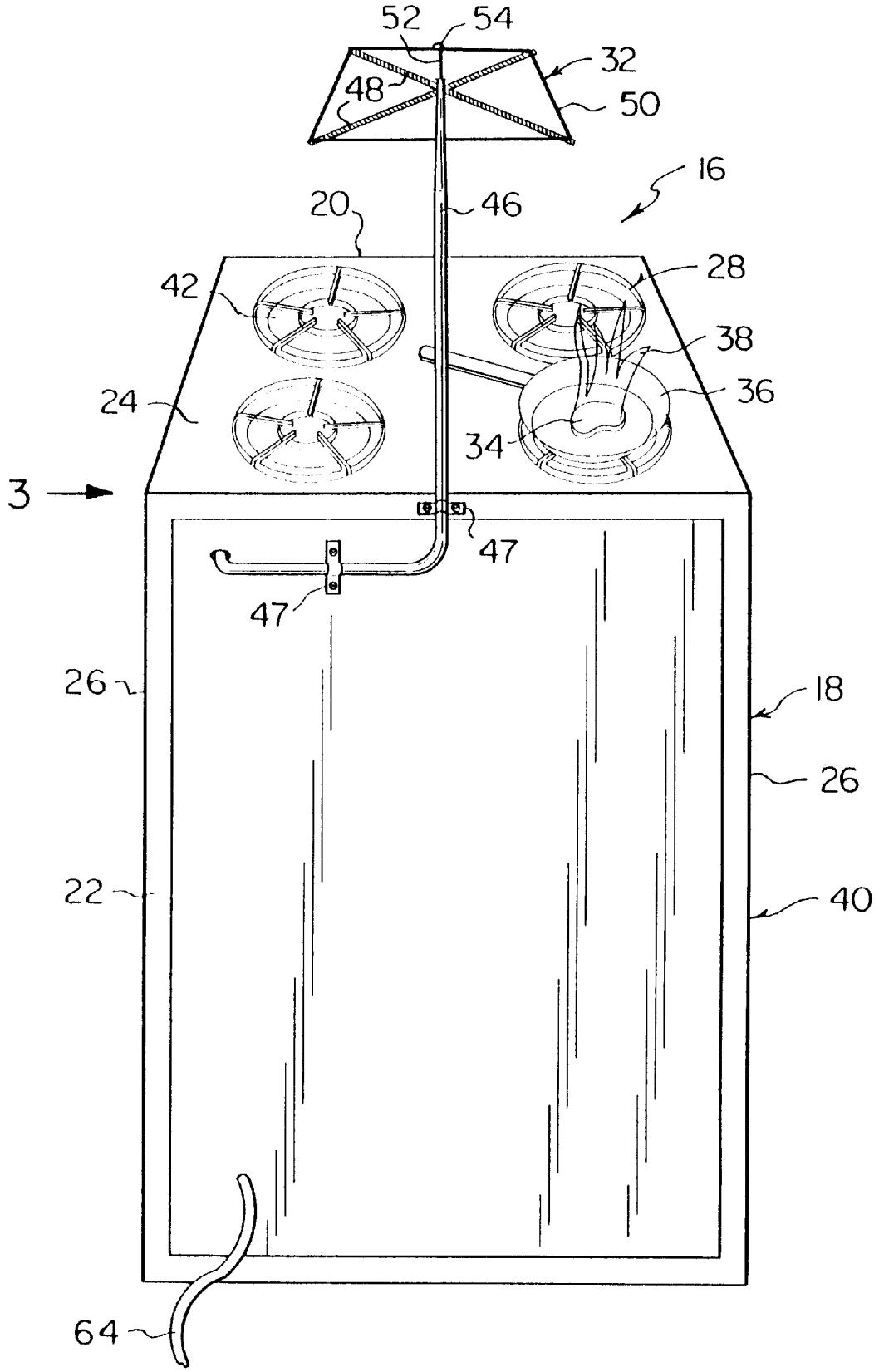
FIG. 2 is a rear perspective view of the first embodiment taken in the direction of arrow 2 in FIG. 1.
Figure 3:
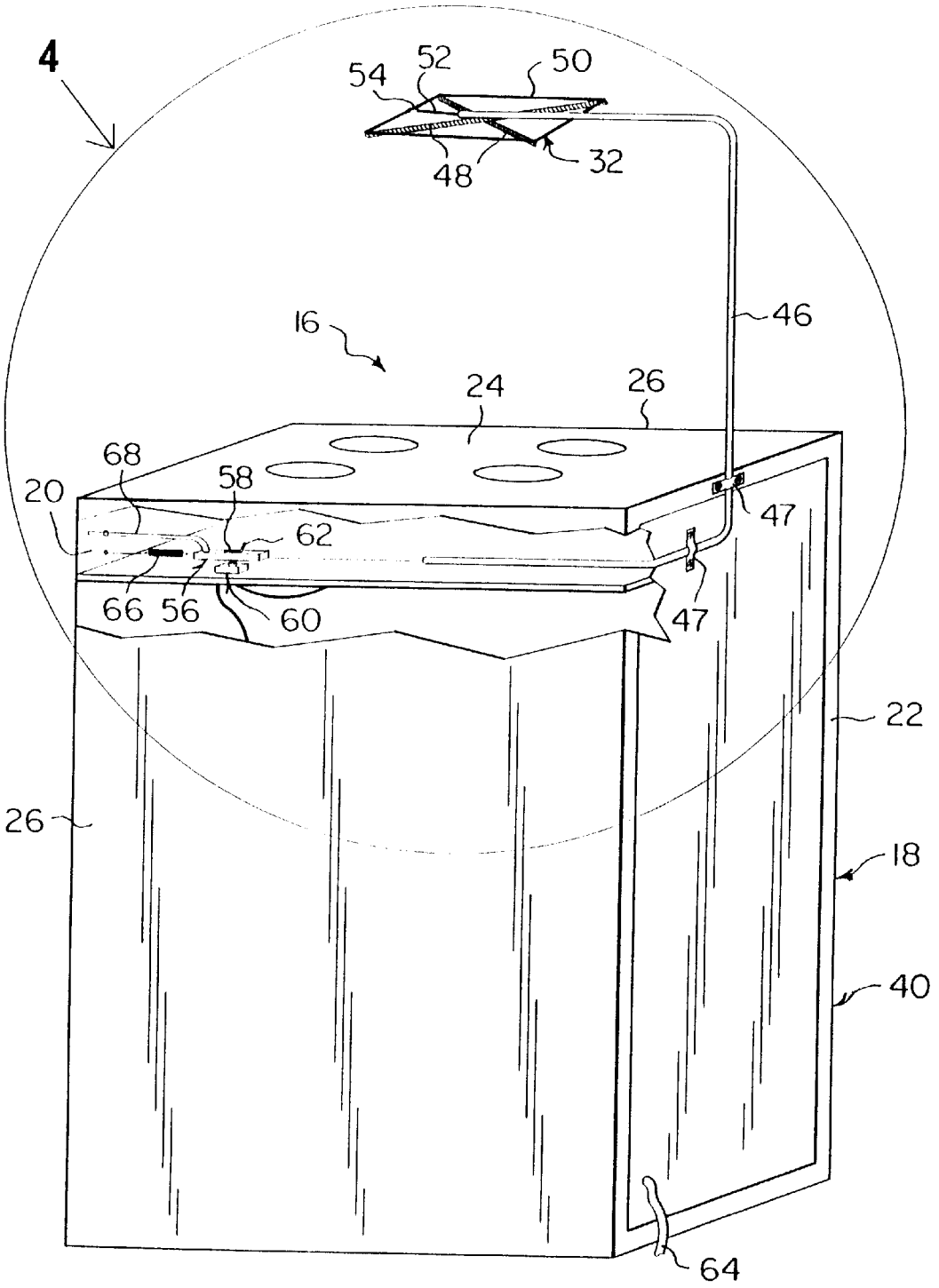
FIG. 3 is a side perspective view of the first embodiment taken in the direction of arrow 3 in FIG. 2, with parts broken away.
Figures 4, 5:
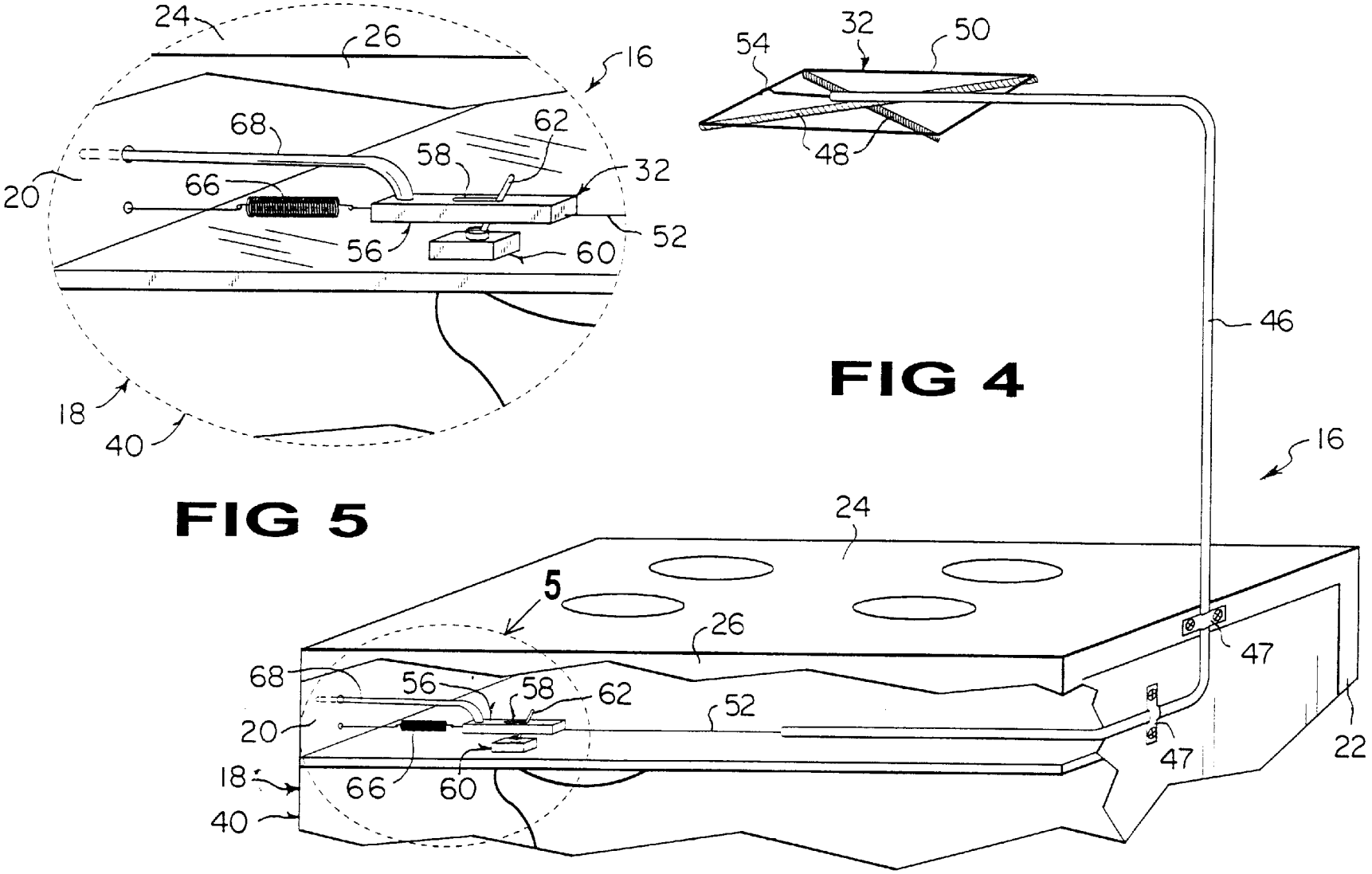
FIG. 4 is an enlarged side perspective view of an area as indicated by arrow 4 in FIG. 3.
FIG. 5 is a further enlarged side perspective view of an area as indicated by arrow 5 in FIG. 4.
Figures 6, 7:
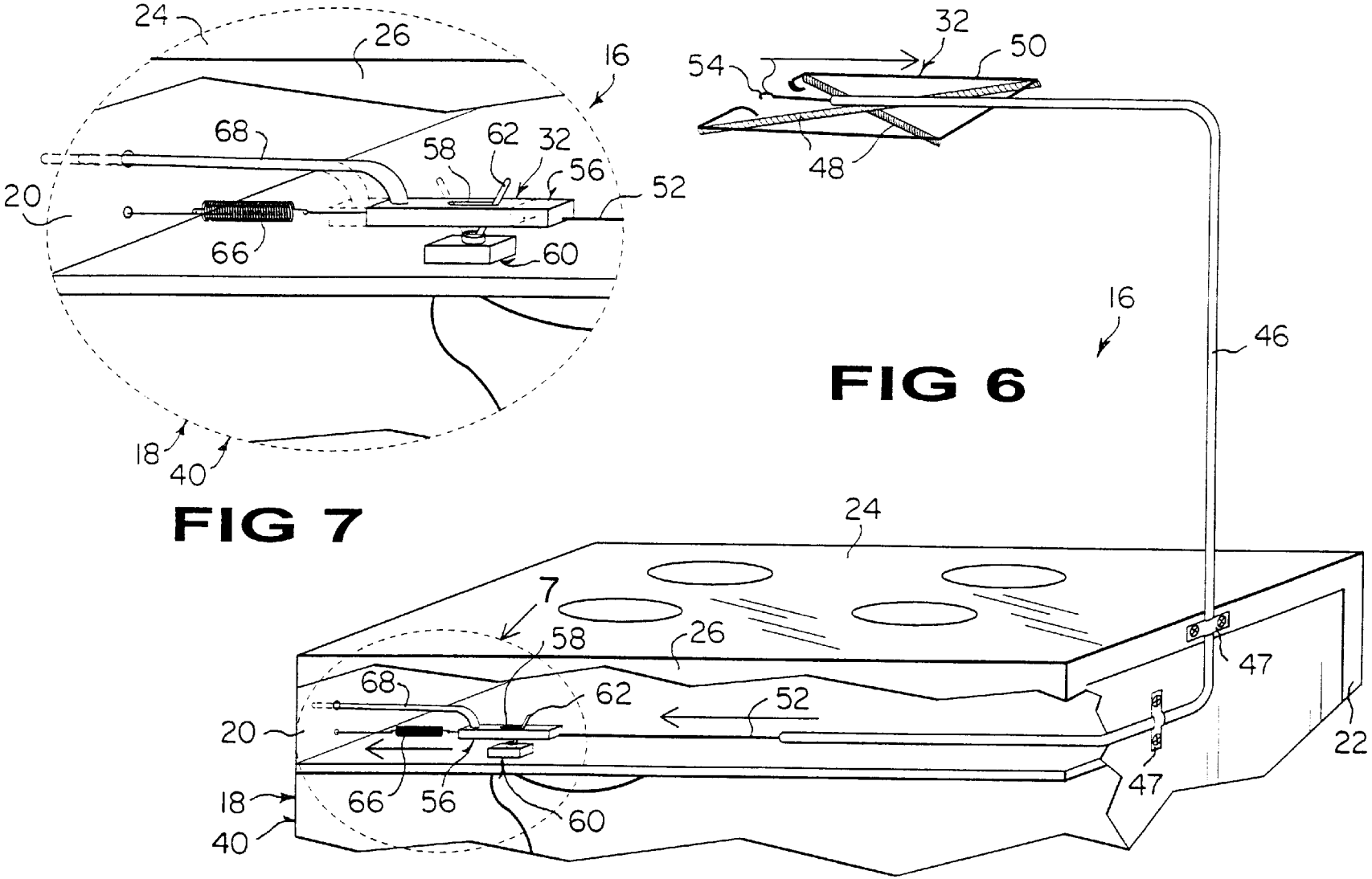
FIG. 6 is an enlarged side perspective view similar to FIG. 4, showing the nylon web burnt away.
FIG. 7 is a further enlarged side perspective view of an area as indicated by arrow 7 in FIG. 6.
Figure 8:
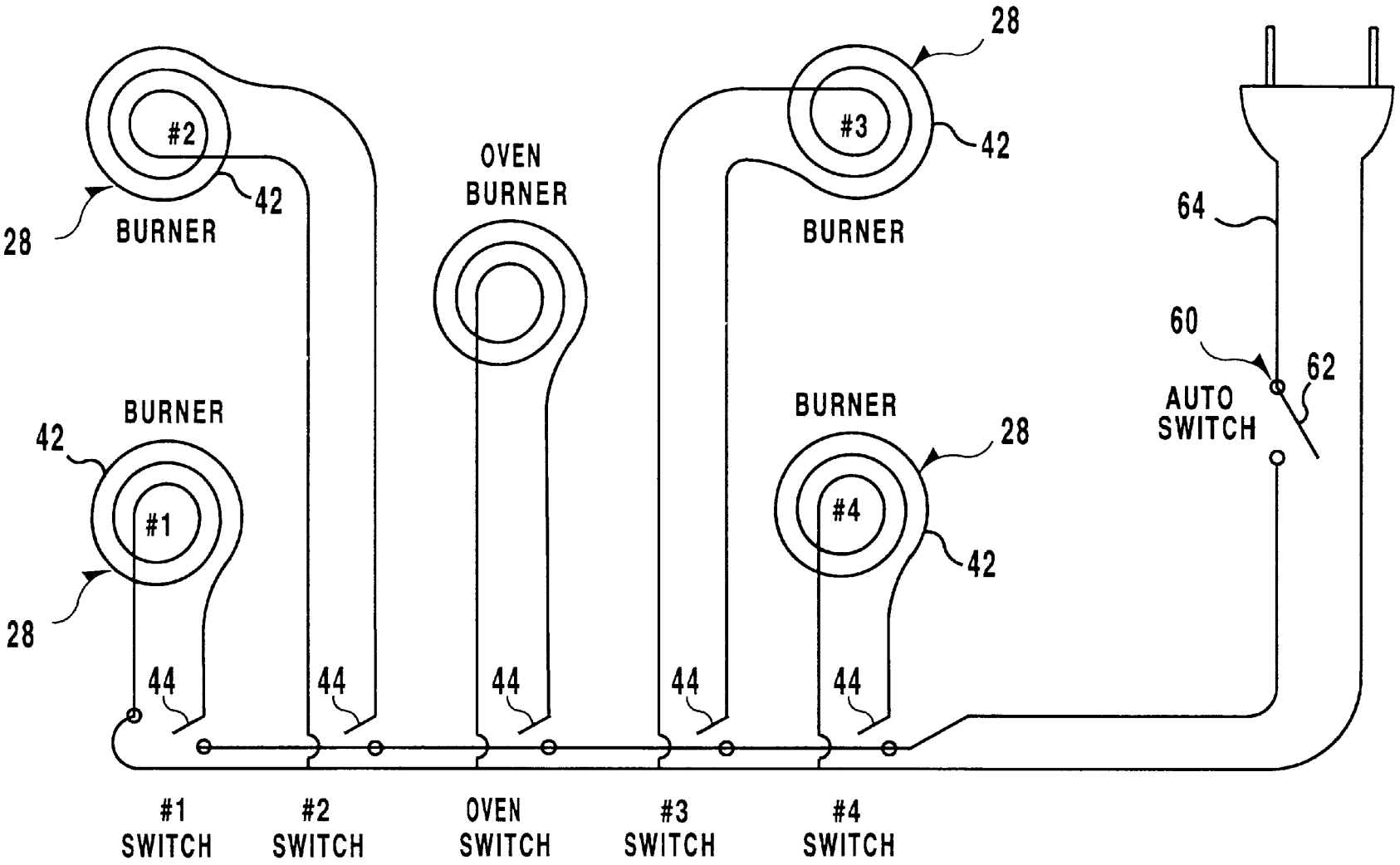
FIG. 8 is an electrical wiring diagram for the first embodiment.

Turning now descriptively to the drawings, in which similar reference characters denote similar elements throughout the several views, FIGS. 1 through 15 illustrate a stove emergency cutoff system 16 comprising a stove 18 having a front wall 20, a rear wall 22, a top wall 24, laterally spaced side walls 26, a plurality of burners 28 in the top wall 24 and a plurality of control knobs 30 for the burners 28 in the front wall 20. A facility 32 is for deactivating any control knob 30 that is turned on when food 34 in a cooking utensil 36 on one of the burners 28 is on fire and is producing a large flame 38, so as to shut down the stove 18, and as a result will cause the fire to go out.

The stove 18 in FIG. 1 to 8, is an electric appliance 40. The burners 28 are electric coils 42 and each control knob 30 operates an electric switch 44 to one electric coil 42.

The deactivating facility 32 consists of an elongated tube 46 extending from within the stove 18, mounted with clamps 47 to and extending up from the rear wall 22 of the stove 18, and bent over the burners 28. A pair of stiff wires 48 are affixed in an X-shaped configuration to a top end of the elongated tube 46 over the burners 18 of the stove 18. A piece of nylon cord 50 is tightly placed about the ends of the stiff wires 48, to form a box-shaped web. A flexible cable 52 passes through the elongated tube 46 with each end of the flexible cable 52 extending out of an opposite end of the elongated tube 46.

A hook 54 is affixed to a top end of the flexible cable 52, to engage with the nylon cord 50. An actuator arm 56 has an aperture 58. The actuator arm 56 is affixed at a first end to a bottom end of the flexible cable 52 within the stove 18. A normally closed master switch 60 has a lever 62 mounted with the stove 18. The master switch 60 is electrically connected between a main electrical power supply line 64 and all of the electrical switches 44 of the burners 28. The lever 62 is engaged to the actuator arm 56 through the aperture 58.

A spring 66 is mounted internally between the front wall 20 of the stove 18 and a second end of the actuator arm 56. When the large flame 38 produced by the fire of the food 34 in the cooking utensil 36 reaches the nylon cord 50 and breaks the nylon cord 50, the hook will be released causing the actuator arm 56 to move forward towards the front wall 20 of the stove 18 by the spring 66, thereby operating the lever 62 to open the master switch 60 and shut off the main electrical power supply line 64 to all of the electric switches 44 of the burners 28.

A reset handle 68 is affixed to the actuator arm 56 and extends outwardly through the front wall 20 of the stove 18 adjacent the control knobs 30. The reset handle 68 can be manually pushed inwardly into the stove 18, to move the actuator arm 56 backwards towards the rear wall 22 of the stove 18 and close the master switch 60 when needed. The deactivating facility 32, as shown in FIGS. 1 to 8, is built into a new electric appliance 40. The stove 18 in FIGS. 9 to 15, is a gas appliance 70. The burners 28 are gas units 72 and each control knob 30 operates a valve 74 to one gas unit 72.

Figure 9:
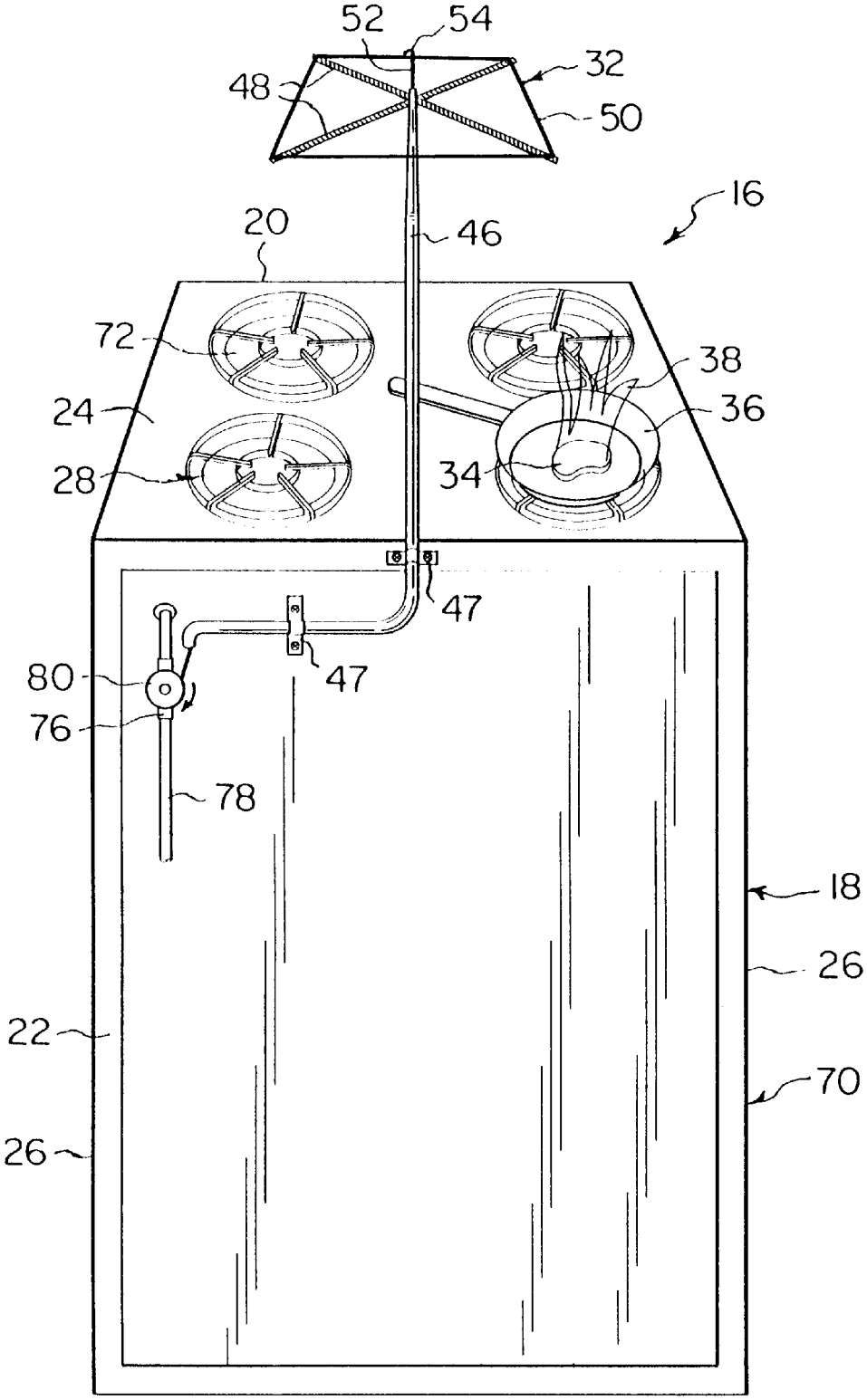
FIG. 9 is a rear perspective view of a second embodiment of the instant invention for an existing gas stove.
Figure 10:
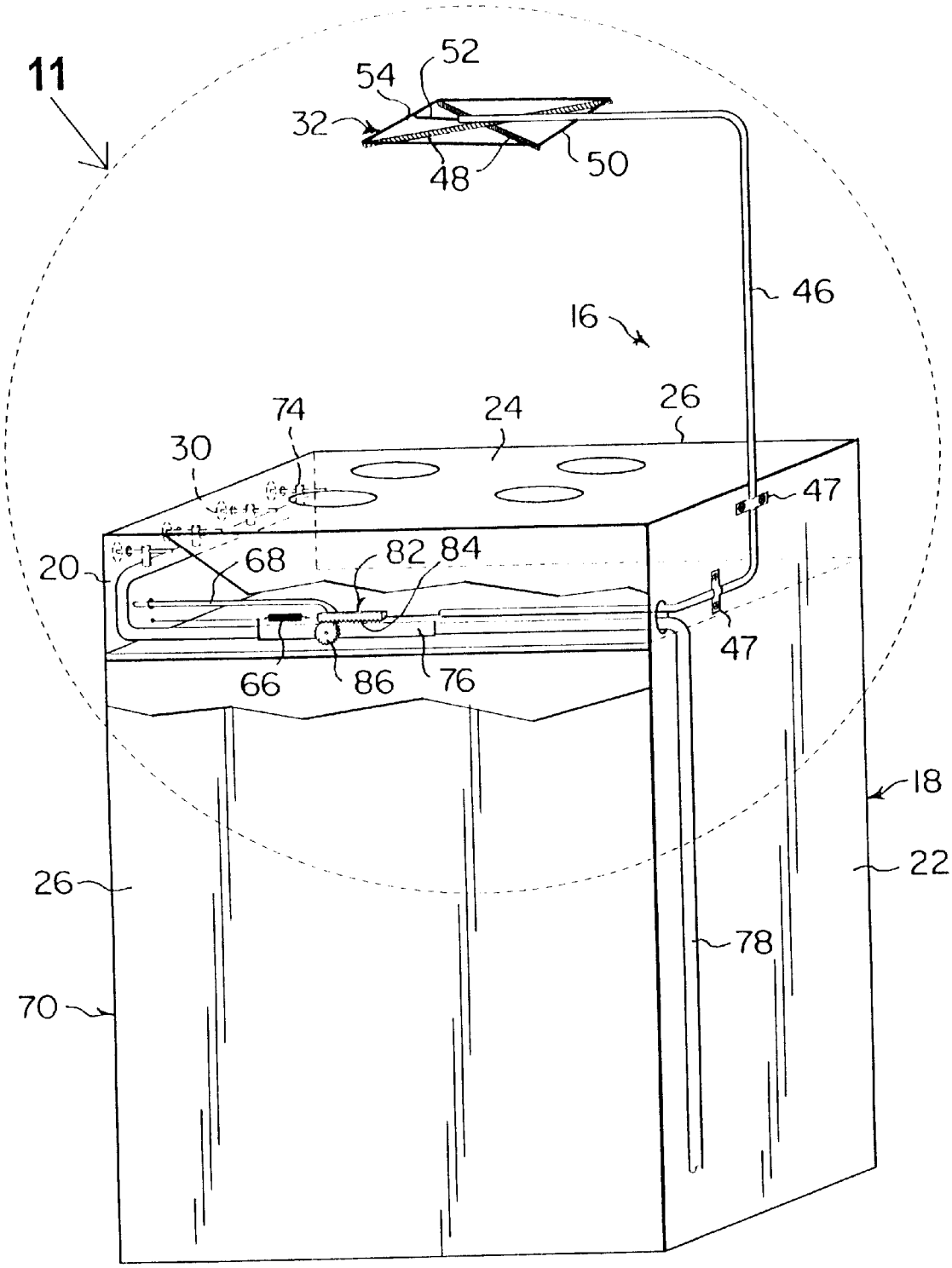
FIG. 10 is a side perspective view of a third embodiment of the instant invention, with parts broken away, for a new gas stove.
Figures 11, 12:
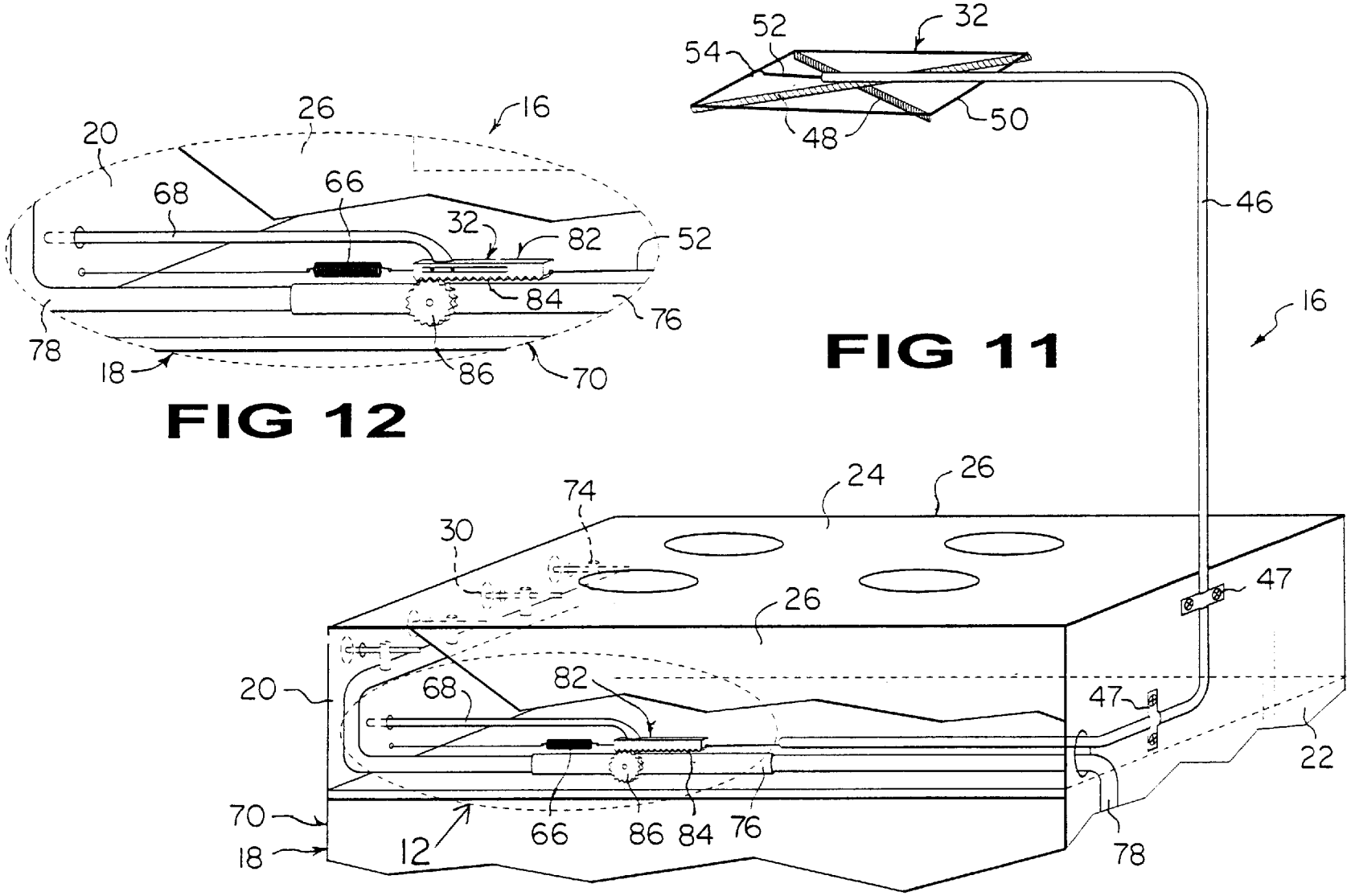
FIG. 11 is an enlarged side perspective view of an area as indicated by arrow 11 in FIG. 10.
FIG. 12 is a further enlarged side perspective view of an area as indicated by arrow 12 in FIG. 11.
Figures 13, 14:
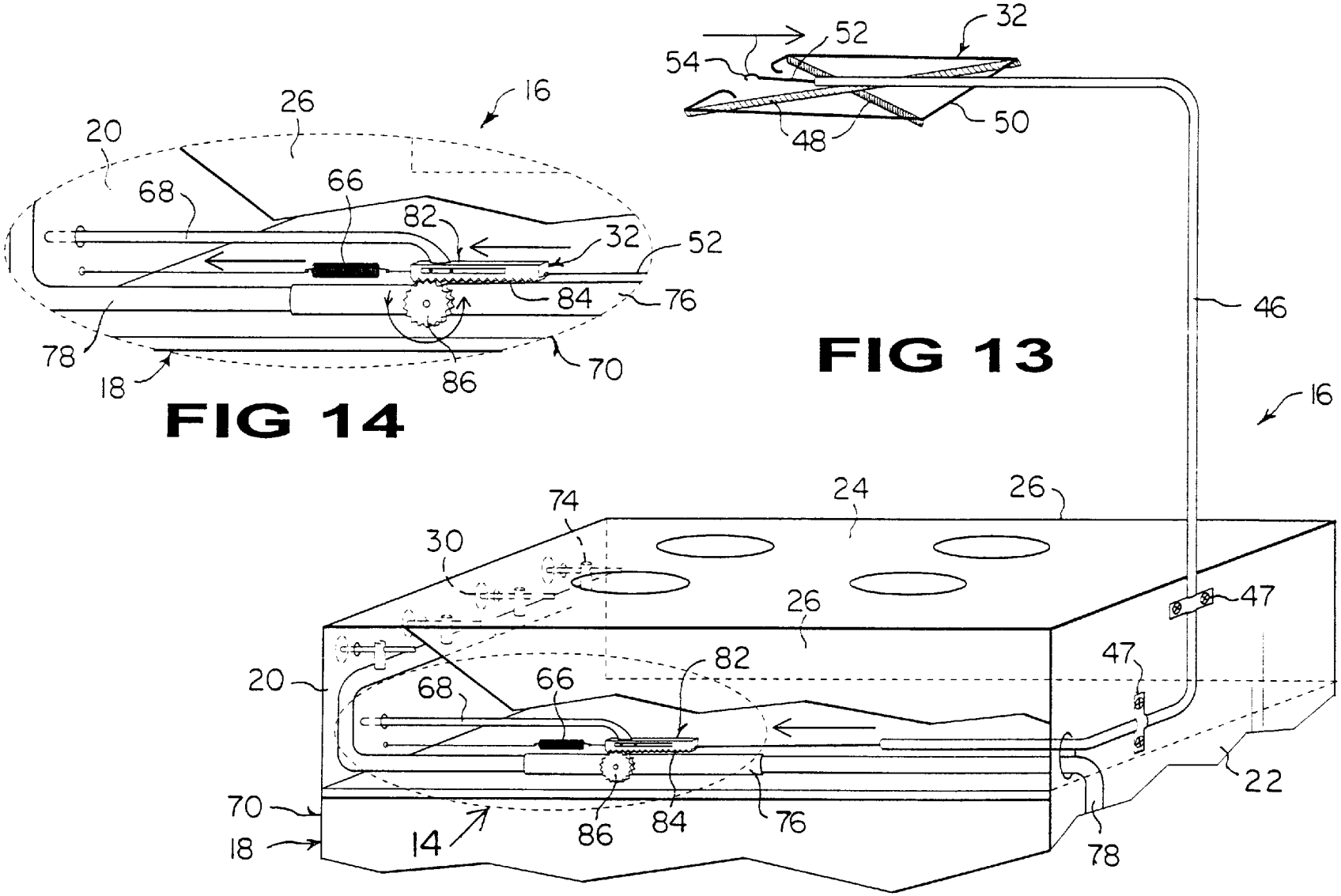
FIG. 13 is an enlarged side perspective view similar to FIG. 11, showing the nylon web burnt away.
FIG. 14 is a further enlarged side perspective view of an area as indicated by arrow 14 in FIG. 13.
Figure 15:
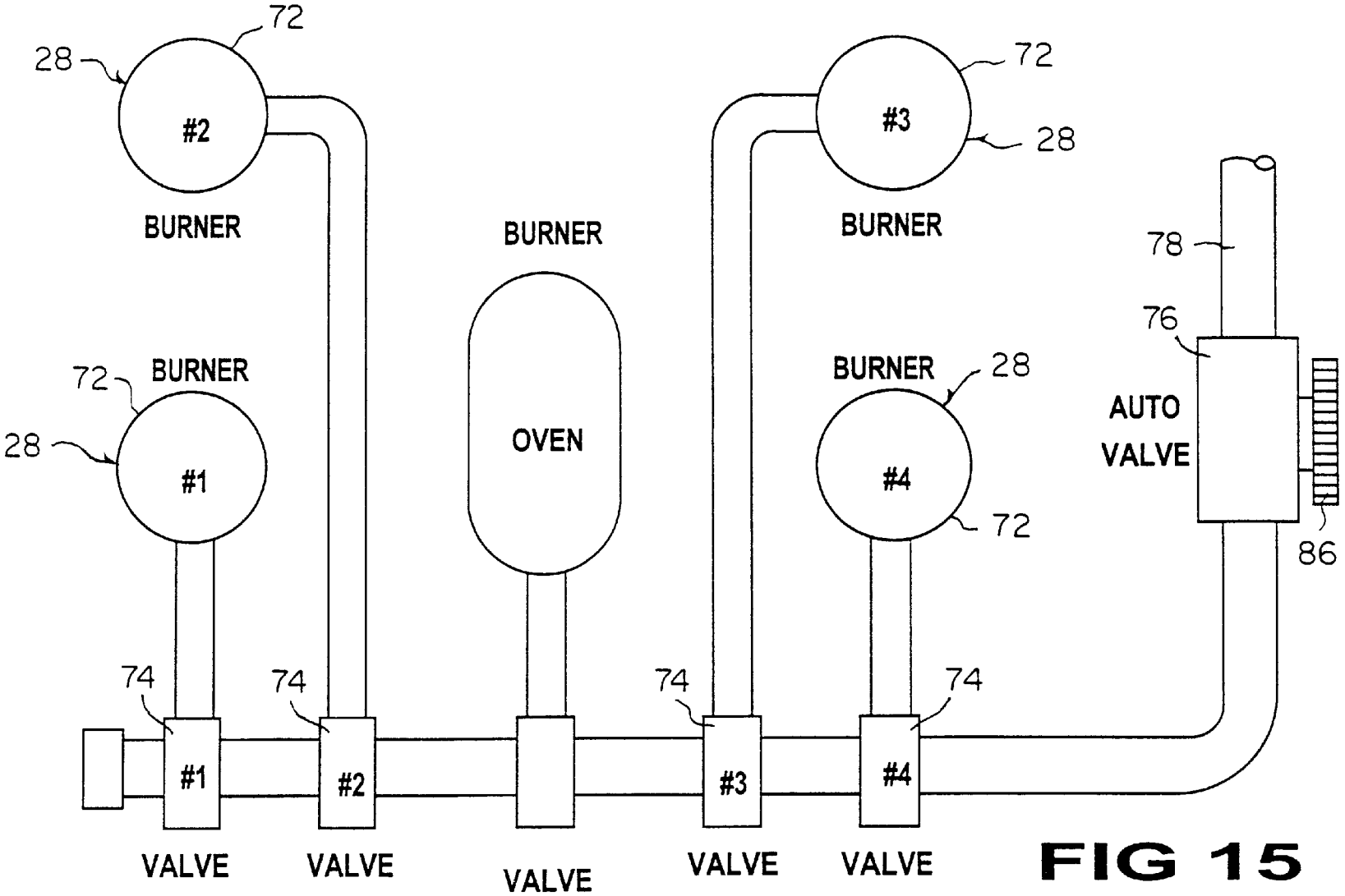
FIG. 15 is a gas line flow diagram for the third embodiment.

The deactivating facility 32 in FIG. 9, consists of the elongated tube 46 mounted with the clamps 47 to and extending up from the rear wall 22 of the stove 18 and bent over the burners 28. The pair of stiff wires 48 are affixed in the X-shaped configuration to the top end of the elongated tube 46 over the burners 28 of the stove 18. The piece of nylon cord 50 is tightly placed about the ends of the stiff wires 48, to form the box-shaped web. The flexible cable 52 passes through the elongated tube 46 with each end of the flexible cable 52 extending out of an opposite end of the elongated tube 46.

The hook 54 is affixed to a top end of the flexible cable 52, to engage with the nylon cord 50. A main valve 76 is mounted on the rear wall 22 of the stove 18 and into a gas A supply line 78 to all of the valves 74 of the burners 28. A pulley knob 80 spring biased on the main valve 76 has a bottom end of the flexible cable 52 affixed thereto. When the large flame 38 produced by the fire of the food 34 in the cooking utensil 36 reaches the nylon cord 50 and brakes the nylon cord 50, the hook 54 will be released causing the pulley knob 78 to rotate, thereby closing the main valve 76 and shut off the gas supply line 78 to all of the valves 74 of the burners 28. The deactivating facility 32 in FIG. 9, is built into an existing as appliance 70.

The deactivating facility 32 in FIGS. 10 to 15, consists of the elongated tube 46 extending from within the stove 18, mounted with the clamps 47 to and extending up from the rear wall 22 of the stove 18 and bent over the burners 28. The pair of stiff wires 48 are affixed in the X-shaped configuration to the top end of the elongated tube 46 over the burners 28 of the stove 18. The piece of nylon cord 50 is tightly placed about the ends of the stiff wires 48, to form the box shaped web. The flexible cable 52 passes through the elongated tube 46 with each end of the flexible cable 52 extending out of an opposite end of the elongated tube 46. The hook 54 is affixed to a top end of the flexible cable 52, to engage with the nylon cord 50.

An actuator arm 82 has a rack 84 formed on a bottom surface thereof. The actuator arm 82 is affixed at a first end to a bottom end of the flexible cable 52 within the stove 18. The main valve 76 is mounted into the gas supply line 78 within the stove 18 to all of the valves 74 of the burners 28. A pinion knob 86 is rotatably connected to the main valve 76 and engages with the rack 84 on the actuator arm 82. The spring 66 is mounted internally between the front wall 20 of the stove 18 and a second end of the actuator arm 82. When the large flame 38 produced by the fire of the food 34 in the cooking utensil 36 reaches the nylon cord 50 and breaks the nylon cord 50, the hook 54 will be released, causing the actuator arm 82 to move forward towards the front wall 20 of the stove 18 by the spring 66. The rack 84 will rotate the pinion knob 86 to close the main valve 76 and shut off the gas supply line 78 to all of the valves 74 of the burners 28.

The reset handle 68 is affixed to the actuator arm 82 and extends outwardly through the front wall 20 of the stove 18 adjacent the control knobs 30. The reset handle 68 can be manually pushed inwardly into the stove 18, to move the actuator arm 82 backwards towards the rear wall 22 of the stove 18 and allows the rack 84 to rotate the pinion knob 86 to open the main valve 76 when needed. The deactivating facility 32, as shown in FIGS. 10 to 14, is built into a new gas appliance 70.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A stove emergency cutoff system comprising:

a) a stove having a front wall, a rear wall, a top wall, laterally spaced side wall, a plurality of burners in said top wall, a plurality of switches, and a plurality of control knobs, wherein each switch is connected between a respective one of said plurality of burners and a power source and each control knob is connected to move a respective one of said plurality of switches between a first position connecting said respective one of said burners to a power source and a second position disconnecting said respective one of said burners from said power source; and b) means connected between each of said plurality of switches and the power source for deactivating any said burner that is connected to the power source when food in a cooking utensil on one of said burners is on fire and producing a large flame, so as to shut down said stove, and as a result will cause the fire to go out said deactivating means including:

i) an elongated tube extending from within said stove, mounted to and extending up from said rear wall of said stove, and bent over said burners;

ii) a pair of stiff wires affixed in an X-shaped configuration to a top end of said elongated tube over said burners of said stove;

iii) a piece of nylon cord tightly placed about the ends of said stiff wires to form a box-shaped web;

iv) a flexible cable passing through said elongated tube with each end of said flexible cable extending out of an opposite end of said elongated tube;

v) a hook affixed to a top end of said flexible cable to engage with said nylon cord;

vi) an actuator arm having an aperture, said actuator arm affixed at a first end to a bottom end of said flexible cable within said stove;

vii) a normally closed master switch having a lever mounted with said stove for engaging said actuator arm when in the normally closed position, said master switch electrically connected between a main electrical power supply line and a terminal of all of said electrical switches of said burners, whereby said lever is engaged to said actuator arm through said aperture; and viii) a spring mounted internally between said front wall of said stove and a second end of said actuator arm, so that when the lare flame produced by the fire of the food in the cooking utensil reaches said nylon cord and breaks said nylon cord said hook is causing said spring to move said actuator arm forward towards said front wall of said stove, thereby disengageing said lever and said actuator arm and opening said master switch and disconnecting the main electrical power supply line from all of said electric switches of said burners, and wherein said stove is an electric appliance, said burners are electric coils.

2. A stove emergency cutoff system as recited in claim 1, further including a reset handle affixed to said actuator arm and extending outwardly through said front wall of said stove adjacent said control knobs, so that said reset handle can be manually pushed inwardly into said stove, to move said actuator arm backwards towards said rear wall of said stove and close said master switch when needed.

3. A stove emergency cutoff system as recited in claim 2, wherein said deactivating means is built into a new electric appliance.

4. A stove emergency cutoff system comprising:

a) a stove having a front wall a rear wall a top wall, laterally spaced side wall, a plurality of bumets in said top wall, a plurality of valves, and a plurality of control knobs, wherein each valve is connected between a respective one of said plurality of burners and a gas supply and each control knob is connected to move a respective one of said plurality of valves between a first posilion connecting said respective one of said burners to the as supply and a second position disconnecting said respective one of said burers from the gas supply; and b) means connected between each of said plurality of valves and the gas supply for deactivating any said burner that is connected to the gas supply when food in a cooking utensil on one of said burners is on fire and producing a large flame, so as to shut down said stoves and as a result will cause the fire to go out, said deactivating means including:

i) an elongated tube extending from within said stove, momted to and extending up from said rear wall of said stove, and bent over said burners;

ii) a pair of stiff wires affixed in an X-shaped configuration to a top end of said elongated tube over said burners of said iii) a piece of nylon cord tightly placed about the ends of said stiff wires to form a box-shaped web;, iv) a flexible cable passing trough said elongated tube with each end of said flexible cable extending out of an opposite end of said elongated tube;

v) a hook affixed to a top end of said flexible cable to engage with said nylon cord;

vi) a main valve mounted on said rear wall of said stove and into a gas supply line, said main valve being connected between said gas supply and all of said plurality of valves;

vii) a pulley knob spring biased on said main valve, said pulley knob having a bottom end of said flexible cable attached thereto, so that when the large flame produced by the fre of the food in the cooking utensil reaches said nylon cord and breaks said nylon coed said hook will be released causing said pulley knob to rotate, thereby closing said a valve and shut off the gas supply line to all of said plurality of valves, and wherein said stove is a gas appliance, said burners are gas Its and each said control knob operates a valve to the gas supply.

5. A stove emergency cutoff system as recited in claim 4, wherein said deactivating means is built into an existing gas appliance.

6. A stove emergency cutoff system comprising:

a) a stove having a front wall, a rear wall, a top wall, laterally spaced side wall, a plurality of burners in said top wall, a plurality of valves, and a plurality of control knobs, wherein each valve is connected between a respective one of said plurality of burners and a gas supply and each control knob is connected to move a respective one of said plurality of valves between a first position connecting said respective one of said burners to the gas supply and a second position disconnecting said respective one of said burners from the gas supply; and b) means connected between each of said plurality of valves and the gas supply for deactivating any said burner that is connected so the gas supply when food in a cooking utensil on one of said burners is on fire and producing a large flame so as to shut down said stove, and as a result will cause the fire to go out, said deactvating means including;

an elongated tube extending from within said stove mounted to and extending up from said rear wall of said stove, and bent over said burners;

ii) a pair of stiff wis affixed in an X-shaped configuration to a top end of said elongated tube over said burners of said stove;

iii) a piee of nylon cord tightly placed about the ends of said stiff wires to form abox-shaped web;

iv) a flexible cable passing through said elongated tube with each end of said flexible cable extending out of an opposite end of said elongated tube;

v) a hook affixed to a top end of said flexible cable to engage with said nylon cord;

vi) an actuator arm having a rack formed on a bottom surface thereof, said actuator am affixed at a irst end to a botton end of said flexible cable within said stove;

vii) a main valve mounted into the gas supply line and connected to all of said valves of said burners;

viii) a pinion knob rotatably connected to said main valve and engaged with said rack on said actuator arm; and ix) a spring mounted internally between said front wall of said stove aid a second end of said actuator arm, so that when the large flame produced by the fire of the food in the cooking utensil reaches said nylon cord and breaks said nylon cord, said hook will be released causing said said actuator arm to move forward towards said front wall of said stove by said spring, causing said rack to rotate and said pinion knob to close said main valve and shut off the gas supply line to all of said valves of said burners, and wherein said stove is a gas appliances said burners are gas units and each said control knob operates a valve to the gas supply.

7. A stove emergency cutoff system as recited in claim 6, further including a reset handle affixed to said actuator arm and extending outwardly through said front wall of said stove adjacent said control knobs, so that said reset handle can be manually pushed inwardly into said stove to move said actuator arm backwards towards said rear wall of said stove and allows said rack to rotate said pinion knob to open said main valve when needed.

8. A stove emergency cutoff system as recited in claim 7, wherein said deactivating means is built into a new gas appliance.

* * * * *